US011033444B2

(12) United States Patent
Mórucz et al.

(10) Patent No.: US 11,033,444 B2
(45) Date of Patent: Jun. 15, 2021

(54) WHEELCHAIR WITH TWO INDEPENDENT DRIVING ARMS

(71) Applicants: László Mórucz, Siófok (HU); Stringbike Kft., Felsőzsolca (HU)

(72) Inventors: László Mórucz, Siófok (HU); Zoltán Kálazi, Budapest (HU)

( * ) Notice: Subject to any disclaimer, the term of this patent is extended or adjusted under 35 U.S.C. 154(b) by 213 days.

(21) Appl. No.: 16/279,238

(22) Filed: Feb. 19, 2019

(65) Prior Publication Data

US 2020/0261289 A1 Aug. 20, 2020

(51) Int. Cl.
*A61G 5/02* (2006.01)
*A61G 5/10* (2006.01)

(52) U.S. Cl.
CPC ..... *A61G 5/025* (2013.01); *A61G 5/1018* (2013.01); *A61G 5/1035* (2013.01); *A61G 5/1051* (2016.11)

(58) Field of Classification Search
CPC .... A61G 5/025; A61G 5/1051; A61G 5/1018; A61G 5/1035; A61G 5/1005
USPC ..... 280/250.1
See application file for complete search history.

(56) References Cited

U.S. PATENT DOCUMENTS 7,900,945 B1 * 3/2011 Rackley ..... A61G 5/023 280/244
8,602,433 B2 * 12/2013 Kohlheb ..... B62M 3/06 280/251
9,162,525 B2 * 10/2015 Lantos ..... B62M 9/00
9,408,762 B1 * 8/2016 Baker ..... A61G 5/0833
10,011,321 B2 * 7/2018 Kohlheb ..... B62K 5/023
2003/0071435 A1 * 4/2003 Schaeffer ..... A61G 5/023 280/248
2004/0051272 A1 * 3/2004 Wong ..... A61G 5/1018 280/244
2013/0015632 A1 * 1/2013 Winter ..... B62M 3/00 280/244

FOREIGN PATENT DOCUMENTS

CN 201469542 * 5/2010
EP 0352350 A1 * 1/1990 ..... A61G 5/023

* cited by examiner

*Primary Examiner* — Jacob B Meyer
*Assistant Examiner* — Sophia Marie McGuire
(74) *Attorney, Agent, or Firm* — Handal and Morofsky, LLC; Anthony H. Handal

(57) ABSTRACT

Wheelchair with two independent driving arms fixed to the frame by pivot bearings at a low position. The driving arms extend to a sufficient height for the user to hold their upper portions and to move them in forward-backward directions around the pivotal bearings. Ropes are connected to the lower sections of the driving arms. Two large wheels have wheel hubs equipped with freewheel, and each wheel hub have a rope drums attached with a spring bias, and a winding made of rope. Pulling a the rope in forward direction results in turning the wheel hub in forward direction, and when the rope drum (31, 31') is turned in the other direction the freewheel releases the connection towards the large wheel. The wheel hub comprises a release mechanism that releases the freewheel when the large wheel is moved in backward direction and backward movement gets allowed.

7 Claims, 4 Drawing Sheets

WHEELCHAIR WITH TWO INDEPENDENT DRIVING ARMS

TECHNICAL FIELD

The invention relates to a wheelchair with two independent driving arms, comprising a seat, two large rear wheels and two front small wheels, wherein the small wheels can be freely turned around a vertical axis, and a common frame for holding the listed parts, and the two driving arms are fixed to the frame by means of respective pivot bearings at a low position close to the places where the small wheels are attached to the frame, and the driving arms extend till a height which is sufficiently high for the person sitting in the wheelchair to hold their upper end portions easily with hands and to move them in forward-backward directions around the pivotal bearings, and both of the large wheels are equipped with respective brakes that can be operated by the driving arms or respective brake handles positioned on the driving arms.

Wheelchairs are used by subjects having different diseases preventing them from normal walking, but a part of such persons have healthy or almost healthy upper body part and they have a need to use their muscles and arms and in such use to drive their own wheelchair. They either do not need the recently widely spread electrical drives or they use such drives only when they want it.

The presence of two rear large wheels is a typical characteristic of conventional wheelchairs and respective hand wheels are mounted on the outside of these large wheels by which the wheelchair can be moved and steered by the hands of the user. This latter is made possible by the free bearing of two small front wheels around respective vertical axes.

BACKGROUND OF THE INVENTION

Although this classical design is rather simple and widely spread, it has the drawback that for the movement of the hand wheels the shoulders should be bent in backward direction and this posture is not healthy from the point of view of the human anatomy and it imposes too high load on the shoulder joints. For hand drives with higher speeds therefore different designs are used in which by means of a so called "docking device" a first wheel with an own drive system can be attached to the wheelchair.

In the publication WO 2014/03002 a solution is described, in which a driving member similar to a handlebar of bicycles is moved in forward and backward direction by pushing and pulling motion, and the handlebar can also be used for steering the vehicle and both the pushing and the pulling phases are utilized for driving. In this solution the driven wheel has a rope-driven hub and at both sides of the hub respective rope drums are arranged, and by means of appropriate guiding of the ropes it is ensured that at one side the rope drives the hub when the handlebar is pushed forward and the similar drive on the other side ensures drive when the handlebar is pulled back. A further characteristic of that wheel hub having respective rope drums at both sides lies in that it uses a special lock releasing mechanism that enables moving the vehicle in backward direction (which is often necessary for wheelchairs). The torque coming from the two rope drums at either sides of the wheel hub is transmitted thereto and to the driven wheel by respective freewheels arranged in the wheel hub. The special lock releasing mechanism senses when the wheel is pushed to move in backward direction and automatically releases the locking that would otherwise be provided by the freewheels to prevent such motion. Such a special design of the rope drive and of the wheel hub is described in detail in the publications WO 2010/084363 and WO 2012/001436 A1, this latter publication is incorporated here by reference.

Although the aforementioned drive is connected with a number of advantages, for certain disabled subjects the connection of a front wheel to their wheelchair that ensures such a drive is often too difficult including the problems of using a docking system for the connection, as it requires both physical strength and skill. Furthermore, the presence of the third wheel, the drive system, the docking device all increase the overall mass to be moved and accordingly a higher power is required for the movement of that increased mass.

When the disabled subject has to make a pulling movement with his/her arms requiring the exertion of force, then in order that the body will be prevented from being shifted in forward direction, a suitable support should be provided. Unfortunately in several cases the feet of the users cannot be used for such a support, and the weight of such subject is often too low so that the existing friction forces will be insufficient to prevent such shifting, therefore the body should be bound to the backrest or frame of the wheelchair by using belts. Such belts are not comfortable and their use is not preferred.

When the wheelchair is to be driven in a healthy way by paying attention to care the shoulder joints then it should be ensured that forces be exerted during pushing and not at pulling arm motions since the counter forces arising at pushing press the subject to the backrest which can provide sufficient support against such forces.

There are known solutions also for driving wheelchairs by driving arms. The document CN103128822 describes a drive in which only a single driving arm is arranged at one side of the wheelchair that is coupled through a transmission including chain to a common driving shaft of the two rear large wheels and turns that shaft. The steering occurs by the turning of the front small wheels and here the small wheels cannot be freely turned around their respective vertical axes. Such a solution can be used only in case when the user has only one hand to move the vehicle. The common drive of the two rear large wheels is connected with several drawbacks, e.g. it does not make possible the conventional hand drive by using hand wheels on the large wheels. The conventional hand drive cannot be used also because the front wheels cannot turn freely, i.e. they cannot follow the direction determined how the large wheels are driven. A still further drawback lies in that this system cannot be realized in a foldable design.

In case of the document EP0352350 A1 the wheelchair has respective driving arms at both sides, and respective complicated transmissions drive the two large wheels. The design provides a way of changing the direction of driving, and according to the adjusted mode the movement of the driving arms moves the large wheel forward or backward. A specialty of this solution lies in that here the conventional hand drive of the large wheels is not possible.

In the drive according to document CN 201469542 U two independent driving arms are used which are mechanically connected to a special disc arranged on the driven wheel by means of a multi stage click and ratchet wheel. The displacement of the driving arm drives the driven wheel in the required direction. This solution does not make possible the conventional hand drive of the large wheels, as the mechanism blocks the free movement of the large wheels in opposite direction.

The task of the invention is to provide a drive with two independent driving arm for wheelchairs which can provide an easy, quiet drive for each of the large wheels and allows the conventional driving of the wheelchair by hand wheels mounted on the large wheels and in which the power demand appears when the driving arm should be pushed forward and not at its pulling.

For solving the task set it has been recognized that the previously referred rope drive should be used separately at both sides of the wheelchair therefore on the wheel hubs on the large wheels there is no need of using respective rope drums at both sides and the previously referred lock release mechanism that allows backward movements can function even if the freewheels and the related accessories are not present at the side where there is no rope drum. Apart from that difference the use of the transmission by rope is ideal as there are no abrading, colliding parts and the drive does not require any lubrication and can be realized in small volume and with small weight.

SUMMARY OF THE INVENTION

According to the invention a wheelchair has been provided with two independent driving arms that comprises a seat, two rear large wheels and two front small wheels, wherein the small wheels can be freely turned around a vertical axis, and also comprises a common frame for holding the listed parts, and according to the invention the two driving arms are fixed to the frame by means of respective pivot bearings at a low position close to the place where the small wheels are attached to the frame, and the driving arms extend till a height which is sufficiently high for the person sitting in the wheelchair to hold their upper end portions easily with hands and to move them in forward-backward directions around the respective pivotal bearings, and both of the large wheels are equipped with respective brakes that can be operated by the driving arms or by respective brake handles positioned on the driving arms, and to respective lower sections of the driving arms respective ropes are connected, and the two large wheels comprise respective wheel hubs each equipped with freewheel, and to one side of each wheel hub a respective one of rope drums is attached, the rope drums are each provided with a spring bias, and a winding made of said rope comprising a predetermined number of turns is provided on the mantle of each rope drum, wherein a predetermined displacement length of the pulling of the rope in forward direction results in a given turning of the associated wheel hub in forward direction because in case of a turning the rope drum in forward direction the freewheel gets locked and moves the wheel hub and the large wheel therewith in that direction, and when the rope drum is turned in the other direction the freewheel releases the connection towards the large wheel, and the wheel hub comprises a release mechanism that releases the locking of the freewheel when the large wheel is moved in backward direction and backward movement gets allowed.

For making the respective drives each symmetric on the wheel drums respective pairs of windings are wound with predetermined number of turns, the ends of the rope are fixed to the associated rope drum past the outermost turns, and their inner ends are lead to respective pairs of pulleys interconnected by a common shaft, and the rope branches leaving the pulleys are united at a third pulley which is fixed to the associated driving arm, and the common shaft interconnecting the pulleys is inserted in a groove made on the associated driving arm.

The changing of the transmission ration of the drive can be made possible if on the driving arms between about the quarter and third of their height a plurality of spaced grooves are provided, and said common shaft can be inserted in any one of said groves as required by a transmission ratio selected by a user.

The steering becomes simpler if respective brake holders are attached to the rear side of the driving arms extending out in backward direction towards the large wheel and a brake pad is attached to each brake holder that in the rearmost position of the associated driving arm gets pressed to a rubber tyre on the large wheel to brake that wheel.

For the attachment of the drive to any wheelchair it is preferred if the frame comprises at its front part at both sides respective vertical support columns and respective support assemblies can be attached thereto by a releasable connection and with adjustable height, and the support assembly holds and supports said pivot bearings of the driving arms.

BRIEF DESCRIPTION OF THE DRAWINGS

The invention will now be described in connection with preferable embodiments thereof in which reference will be made to the accompanying drawings. In the drawing.

DETAILED DESCRIPTION OF THE INVENTION

Figure 1:
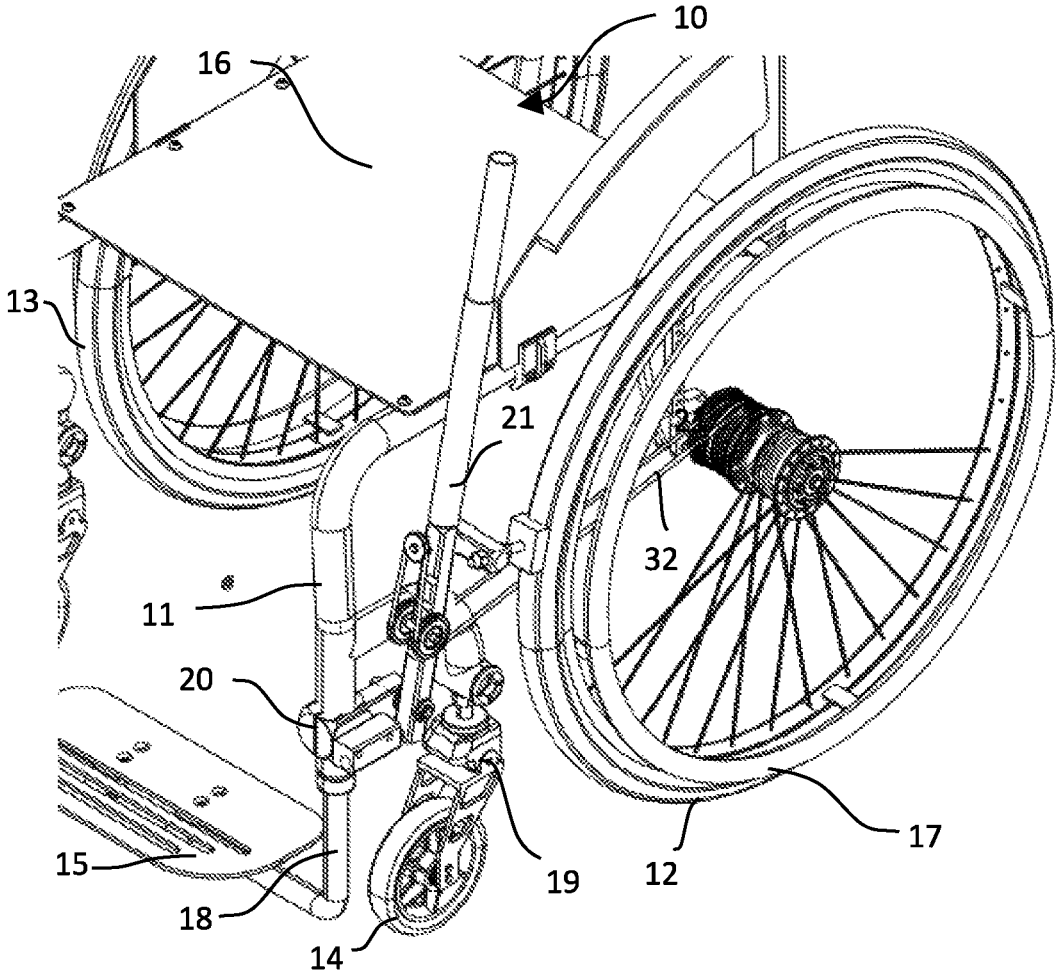
FIG. 1 shows the perspective view of a wheelchair provided with the drive according to the invention in a partial view.

FIG. 1 shows a part of a wheelchair 10 in perspective view that has a frame 11, respective rear large wheels 12, 13 attached to the two sides of the frame and two small front wheels 14. In FIG. 1 only the left mall wheel can be seen and the design and the attachment to the frame 11 of the right front small wheel is the same as that of the left front small wheel shown in the drawing. In the central portion of the frame a seat 16 is provided which has a suitable height and ensures a comfortable support for the disabled subject. The parts described enable the foldable design of the wheelchair that can be realized in a number of conventional ways. In view of the fact that a high number of wheelchair designs is known and used, the known elements have been shown in a symbolic way with the details required for their identifications. This is the reason why not all of the sprockets of the large wheel 12 have been shown or the back support is missing and also few part from the right side of the wheelchair. In case of the drive according to the invention the components on the right and left sides are the same, therefore for the sake of distinction the reference numerals for the parts in the right side were distinguished with a ' symbol from the numerals of the corresponding parts at the left side.

Each of the rear large wheels 12, 13 holds a respective hand wheel 17 fixed to it in a concentric position that has a smaller diameter and spaced outwardly from the large wheel in lateral direction, manufactured preferably from a stainless steel tube with a smooth pouter surface and have the task to enable conventional manual drive and steering the wheelchair 10.

In front of the seat 16 a footrest board 15 is provided at the height of the feet of the user, also held by the frame 11. The small wheels 14 are pivotally fixed that allows free turning around respective vertical axes and they are mounted to respective vertical frontal lateral support columns of the frame 11 of which FIG. 1 shows the left support column 18. The ends of the horizontal pivot shaft of the small wheel 14 are held from the two sides by vertical branches of a vertically extending fork 19 that has a vertical bearing with a bearing shaft attached to a curved rod or tube fixed to the support column e.g. by welding.

In FIG. 1 a support assembly 20 can be seen fixed in a releasable way to the lower portion of the support column 18 that has the task of holding the lower end of left driving arm 21 of the drive according to the invention so that the arm can be pivotally turned around a horizontal axis. In the present specification the terms "left and right" are related to the subject sitting in the seat 16. The design of the drive will be explained in connection with FIGS. 2 and 3 in which for the sake of better illustration the small wheels and the seat have not been shown.

Figure 2:
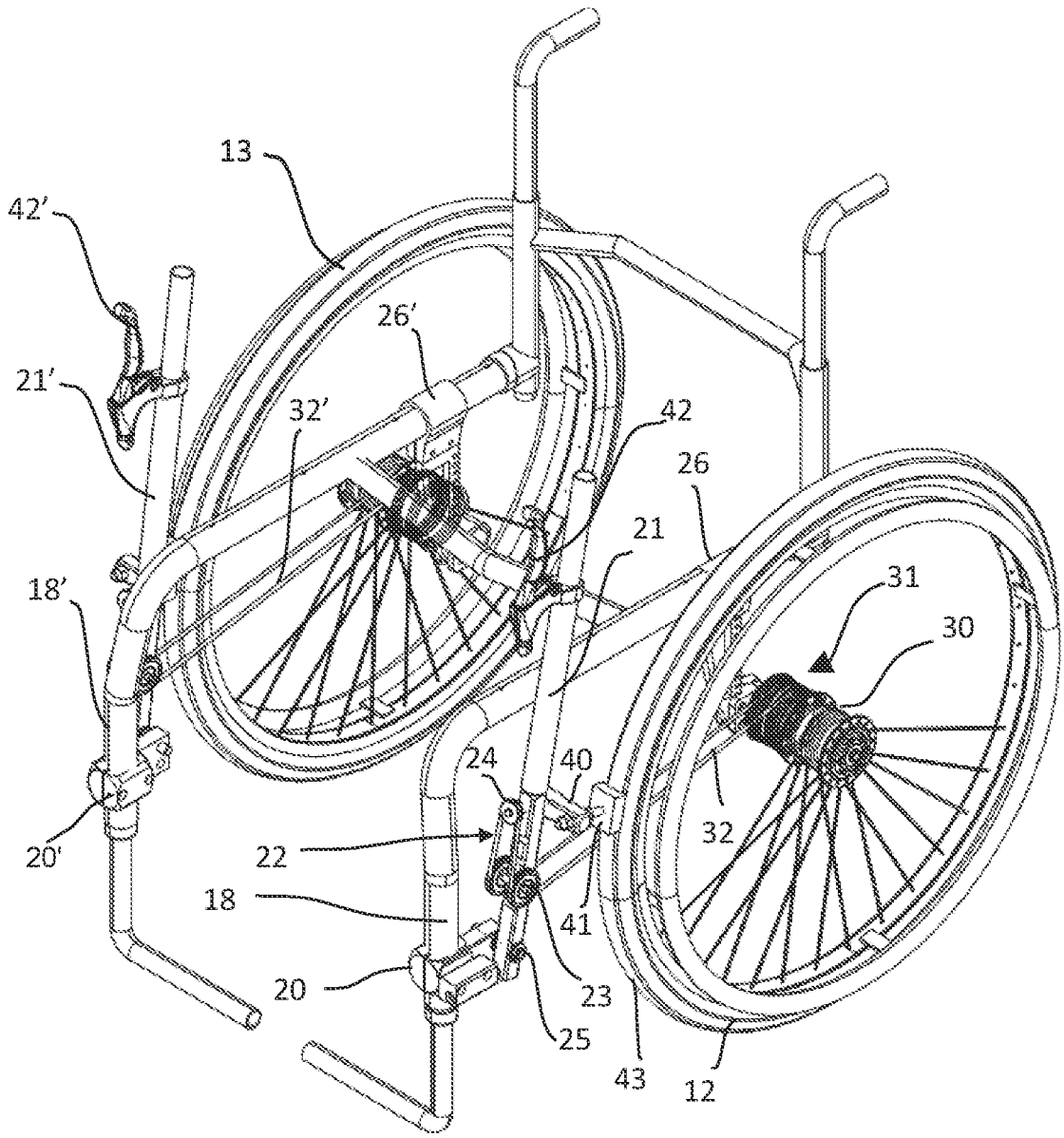
FIG. 2 is a view similar to FIG. 1 from which certain parts were left out for the sake of better visualization, wherein the large wheels are in braked state.

FIG. 2 both the left support column 18 and the right support column 18' of the frame 11 are shown and a support assembly 20' is provided also at the right side of the frame 11 holding a right driving arm 21'. On the driving arms 21, 21' in a position between about the quarter and third of their height a respective rope guide means 22, 22' is arranged that each comprise a pair of pulling pulleys 23 mounted at ends of a short horizontal shaft and a pulley 24 arranged at a higher level and has the task of uniting the rope branches coming from the pulleys 23. At the lower section of the driving arm 21, 21' a plurality of horizontal grooves are provided which are arranged in small vertical distances under each other, and the shaft interconnecting the pulleys 23 can be inserted in any one of the grooves and the groove in which the shaft is inserted keeps the height of the shaft during the forward-backward movement of the driving arm. If the pulleys 23 with the interconnecting shaft are removed by hand from the holding groove then the shaft can be inserted in one of the other grooves arranged above or below it, and thereby the distance between the shaft and the pivot bearing 25 of the driving arm 21 can be changed. The change of that distance changes the extent of the forward-backward displacement of the pulleys 23 when the driving arm 21 is moved around the pivot bearing 25 forward and backward and this determined the transmission ration of the drive.

The large wheels 12, 13 are held by respective mounting brackets 26, 26' fixed to the frame 11, and the respective wheel hubs 30, 30' of the large wheels 12, 13 are fixed to the end portions of the mounting brackets 26, 26'. The wheel hubs 30, 30' are provided with respective rope drums 31, 31' and their design and the way of fixing the wheel hubs 31, 31' to the frame is substantially the same as it is illustrated in FIG. 7 of the publication WO 2010/084363 A1 and in the publication WO2012/001436A1. The substantial difference compared to such known solution lies in that in that solution respective rope drums were arranged at both sides of the wheel hub, and the single wheel was driven by respective drives on either sides, whereas in the present case on the large wheel 12 a single rope drum 31 is arranged at the inner side, and that large wheel 12 can be driven only by the driving arm 21 on the left side.

The alternating (reciprocating) movements of the driving arms 21, 21' are transferred to the rope drums 30, 30' by means of respective flexible ropes 32, 32'. On the outer mantle of each rope drum preferably on both sides respective windings are provided that comprise 3 or 4 turns and wound in opposite directions, and the ends of the associated rope 32 or 32' are fixed to the outer edges of the rope drums 31 or 31' after the end of the outermost turn of the windings. The two inner threads of the windings on a rope drum are lead around the respective pairs of pulleys 23, 23' fixed to the respective driving arms 21, 21' and these threads are united at the pulley 24, 24' that has fixed position. The advantage of such a double rope arrangement lies in that the resulting rope forces acting on a rope drum will always lie in a central plane between the two windings and the resulting forces acting on the respective pairs of pulleys 23 will also be in a central plane between the pulleys. The lateral width of the rope drums can be decreased by using only a single winding and by using only a single pulley but in such a situation the central plane of the forces will follow the change of the width of the winding during the up- and down winding movement of the rope drum during operation.

It is noted furthermore that the ropes 32, 32' are biased with a predetermined force by respective springs arranged in the interior of the associated rope drums 31, 31' which are not visible in the drawing, therefore the ropes 32, 32' are always under tension, and this bias assists also the user in the sense when the driving arms 21 or 21' have reached their extreme frontal positions then it helps for the driving arms 21, 21' to return to their initial positions.

In spite of the several similarities there are also substantial differences between the operation of the present invention and of the rope drives disclosed in the referred publication. In the drive designed for disabled subjects and published in WO 2014/030022 there was only a single driven wheel and there was a driving handlebar held by two hands of the user which provided also the possibility of steering the vehicle, and both the pushing and the pulling of the handlebar resulted in the driving of the single wheel. In contrast thereto in the solution according to the invention the driving arm 21 can drive only the large wheel 12, and on the right side the driving arm 21' can drive only the large wheel 13. Out of the reciprocating front-back movement of driving arms 21, 21' only the movement in one direction can drive, in the exemplary case the pushing movement i.e. when the driving arm 21 is pushed in forward direction. For the backward movement there is no need to exercise force and the return movement is also assisted by the bias of the rope.

Figure 4:
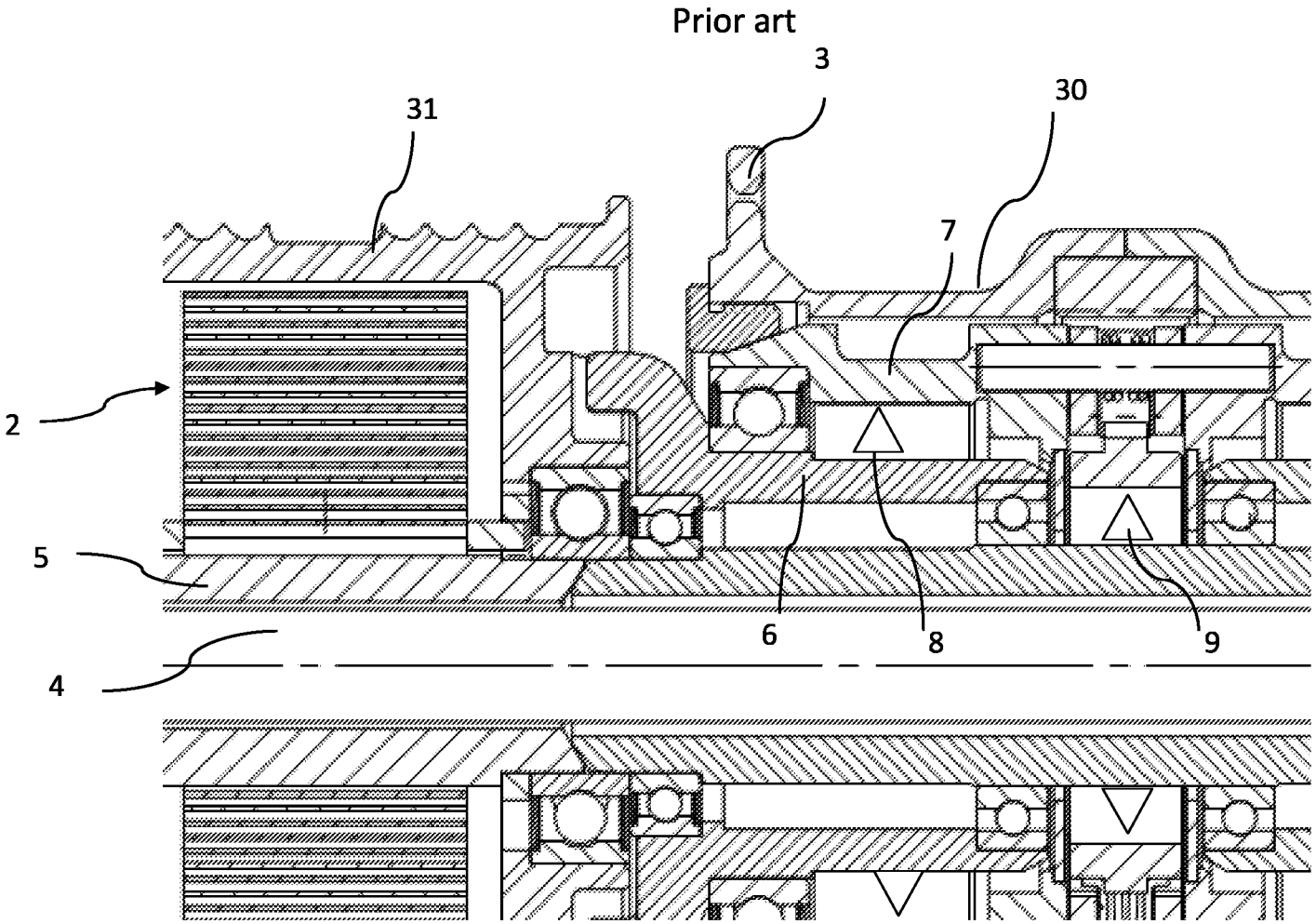
FIG. 4 is the same as FIG. 6 of the document WO 2012/001436 A1.

Besides the above circumstance there is a further phenomenon: in order that the backward turning of the rope drums 31, 31' (which takes place under the effect of the bias) cannot disturb the movement of the driven wheel, a freewheel is used in the hub. At the same time in several occurrences it is required by the user to move the wheelchair 10 (or at least one its large wheels) in backward direction. In such a movement the freewheel gets locked making such backward movement impossible. The publication WO 2012/001436 A1 has already realized such a problem and arranged a further freewheel in the interior of the hub which releases the previous freewheel used for driving the hub. Such a release enables that the drive wheel can be moved in backward direction. For a closer visualization of the structure of such a wheel hub 30 FIG. 4 is the same as FIG. 6 of that publication WO 2012/001436A1 that shows an enlarged portion of the wheel hub 30 as connected to the rope drum 31. In this sectional view it can be seen that the hollow interior of the rope drum 31 provides space for biasing spring 2. The wheel hub 30 has a cylindrical mantle with respective rims at the edge regions of which rim 3 is shown, and this holds the sprockets of the large wheel 12 (not shown) whereby the large wheel moves together with the wheel hub 30. The wheel hub 30 and the rope drum 31 are interconnected with a central shaft 4 by which the large wheel can be mounted to the frame 11. The interior of the wheel hub 30 comprises bearings and a central sleeve 5 made of mutually connected parts and a hollow inner support 6 and an outer support 7, and the first freewheel 8 is arranged between these two supports 6 and 7. Further to the interior of the wheel hub 30 the further freewheel 9 is arranged, which is connected between the central sleeve 5 and the outer support 7 and also connected through a special mechanism to the outer mantle of the wheel hub 30. When the rope drum 31 is turned in forward direction, the first freewheel 8 gets locked and the turning movement is transmitted to the wheel hub 30 which will rotate the large wheel 12 in forward direction. When the driving arm 21 is pulled back, the biasing spring 2 turns the rope drum 31 in the other direction, and by this return movement the first freewheel 8 gets loose and the wheel hub 30 will not follow this return rotation. When the driving arm 21 is not moved but the user or any assistant moves the wheelchair 10 in backward direction, the further freewheel 9 gets locked, and by using the mechanism connected to its outer ring disengages the connection between the outer support 7 and the wheel hub 30, and the locking of the first freewheel 8 cannot prevent the rotation of the wheel hub 30 in backward direction. The referred publication includes a more detailed description of the structure and operation of such a rear hub.

At the present invention most parts of the here referred known wheel hub solution can be used, but it should be taken into account that in our case there is no need for the second rope drum at the other side of the wheel hub, as well as to the parts required between the second rope drum and the wheel hub, therefore the wheel hub used in the present invention can be made in a narrower design with less weight and number of parts, but the main function, namely the possibility of turning the large wheel in backward direction remains unchanged.

Figure 3:
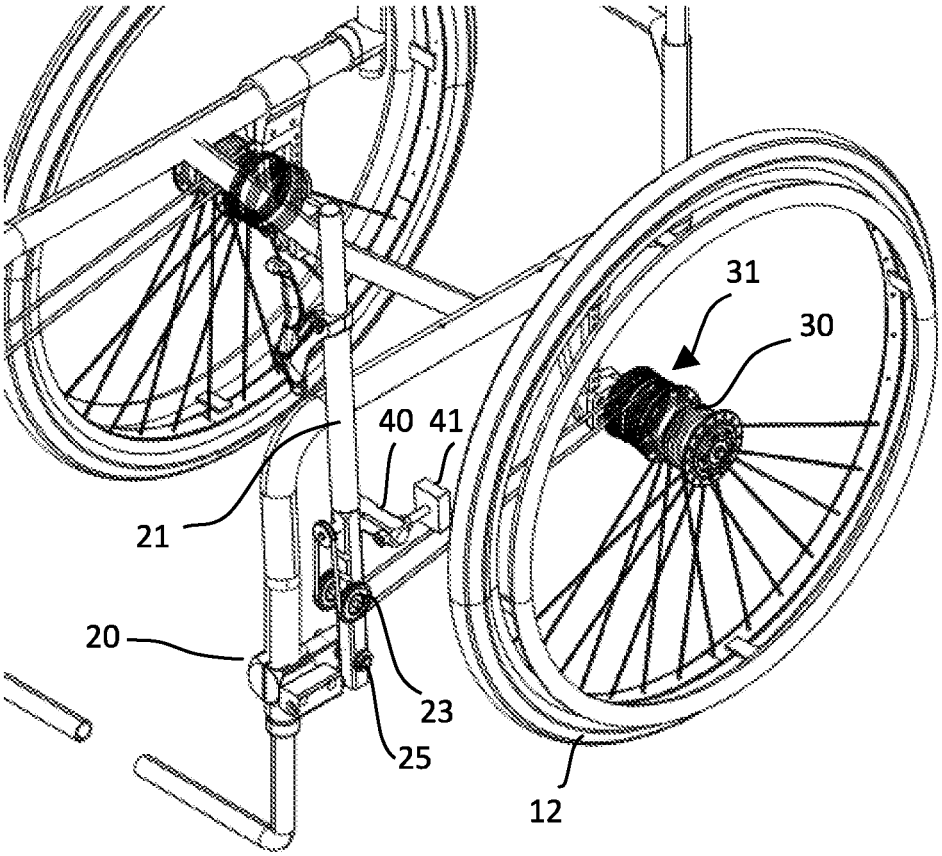
FIG. 3 is a sketch similar to FIG. 2 showing the wheelchair without being braked.

Before describing the way of operation of the subject drive reference is made to brake holder 40 and brake pad 41 shown only on the left side in FIGS. 2 and 3. In FIG. 2 the driving arm 21 is in its rearmost, braking position in which the brake holder 40 presses the brake pad 41 to the rubber tyre 43 on the large wheel 12 and prevents thereby any movement of this large wheel 12. FIG. 3 shows the different free position of the drive when the driving arm 21 is in a different (driving) more forward position when the brake pad 41 does not contact the rubber tyre 43 and the large wheel 12 can be moved without being braked.

Of course, the braking of the large wheel 12 cannot be resolved only in this exemplary simple way, but on the driving arms 21, 21' one can arrange conventional brake handles 42, 42' by which any conventional brake arranged to brake the large wheels 12 or 13 can be operated.

The driving of the wheelchair 10 can take place according to the wish and need of the user in one of two ways, By using the hand wheel 17 the conventional drive can be used at any time, e.g. in a room or in a tight place the well learned maneuvering can be carried out thereby. When the wheelchair 10 is driven with the solution according to the invention then the two driving arms 21, 21' should be pushed and pulled by grasping respective handles (not shown in the drawing) pulled on the upper end portions of the driving arms 21, 21' by pulling and pushing movements. In the pushing phase of this reciprocating movement the force of the user pushes the driving arms 21, 21' in forward direction, whereby the pairs of pulleys 23, 23' will also move forward and the ropes 32, 32' wound around the rope drums 31, 31' will be forced to get the same extent unwound and turns the wheel hub and moves the large wheels 12, 13 accordingly in forward direction. Any small extent of pushing forward will turn the large wheels and the user can determine the extent of speed in line with his/her physical strength and mood. On steeper roads one can proceed with small movements in a modest way but if the user wants to proceed faster, a higher speed can be attained with quick and large movements. The transmission ratio can be changed by moving the shaft interconnecting the pair of pulleys 23 upwards or downwards along the driving arm 21.

Because the driving force should be exercised at the pushing phase (when the driving arms 21, 21' are moved forward) the arising counter forces will push the user towards the backrest of the seat and this is the safe direction, because if the counter forces acted in the reverse (forward) direction then this force would try to move the user out of the chair which would be difficult to counteract by the user in view of his/her light weight and possible body limitations. Of course, by the use of an appropriate direction reversing mechanism it can also be solved that the rope 32 move forward when the driving arms 21, 21' are pulled backwards. Such a direction reversing mechanism is exemplified e.g. in the publication WO 2014/030022.

For steering the wheelchair 10 a first possibility is the driving of the two large wheels with different speeds, but for making sudden curves the driving arm located in the inner side of the planned curve should be pulled backwards, then the appropriate brake pad 41 or 41' will get pressed against the tyre 43 or 43' behind it and stops the wheel. The wheelchair 10 will then be turned around the contact point of this braked wheel and the ground as a turning centre if on the other outer side the large wheel 12 or 13 is driven. The solution according to the invention provides therefore also an efficient steering and it has the advantages of the rope drive, because it is quiet, clean, has small weight and can be equipped to existing wheelchairs without requiring any substantial restructuring of its design.

The invention claimed is:

1. Wheelchair (10) with two independent driving arms (21, 21'), comprising a seat (16), two rear large wheels (12, 13) and two front small wheels (14), wherein the small wheels (14) can be freely turned around a vertical axis, and a common frame (11) for holding the listed parts, and the two driving arms (21, 21') are fixed to the frame (11) by means of respective pivot bearings (25), characterized in that the pivot bearings (25) are fixed at a low position close to a place where the small wheels (14) are attached to the frame (11), and the driving arms (21, 21') extend till a height which is sufficiently high for the person sitting in the wheelchair (10) to hold their upper end portions with hands and to move them in forward-backward directions around the respective pivotal bearings, and both of the large wheels (12, 13) are equipped with respective brakes that can be operated by the driving arms (21, 21') or by respective brake handles (42) positioned on the driving arms (21, 21'), and to respective lower sections of the driving arms (21, 21') respective ropes (32, 32') are connected, and the two large wheels (12, 13) comprise respective wheel hubs (30, 30') each equipped with a first and a further freewheel (8, 9), and to one side of each wheel hub (30, 30') a respective one of rope drums (31, 31') is attached, the rope drums (31, 31') are each provided with a biasing spring (2), and a winding made of said rope (32, 32') comprising a predetermined number of turns is provided on a mantle of each rope drum (31, 31'), wherein a predetermined displacement length of the pulling of the rope (32, 32') in forward direction results in a given turning of the associated wheel hub (30, 30') in forward direction because in case of a turning the rope drum (31, 31') in forward direction the first freewheel (8) gets locked and moves the wheel hub (30, 30') and the large wheel (12 or 13) therewith in that direction, and when the rope drum (31, 31') is turned in the other direction the first freewheel (8) releases the connection towards the large wheel (12 or 13), and the wheel hub (30, 30') comprises a release mechanism comprising the second freewheel (9) that releases the locking of the first freewheel (8) when the large wheel (12 or 13) is moved in backward direction and backward movement gets allowed.

2. The wheelchair as claimed in claim 1, wherein on the wheel drums (31, 31') respective pairs of windings are wound with the predetermined number of turns, the ends of the rope (32, 32') are fixed to the associated rope drum (31, 31') past the outermost turns, and their inner ends are lead to respective pairs of pulleys (23) interconnected by a common shaft, and the rope branches leaving the pulleys (23) are united at a third pulley (24) which is fixed to the associated driving arm (21, 21'), and the common shaft interconnecting the pulleys (23) is inserted in a groove made on the associated driving arm (31, 31').

3. The wheelchair as claimed in claim 2, wherein on the driving arms (21, 21') between about the quarter and third of their height a plurality of spaced grooves are provided, and said common shaft can be inserted in any one of said grooves as required by a transmission ratio selected by a user.

4. The wheelchair as claimed in claim 1, wherein respective brake holders (40, 40') are attached to the rear side of said driving arms (21, 21') extending out in backward direction towards the large wheel (12 or 13) and a respective brake pad (41 or 41') is attached to each brake holder (40, 40') that in the rearmost position of the associated driving arm (21, 21') gets pressed to a rubber tyre on the large wheel (12, 13) to brake that wheel.

5. The wheelchair as claimed in claim 1, wherein the frame (11) comprises at its front part at both sides respective vertical support columns (18, 18') and respective support assemblies (20, 20') can be attached thereto by a releasable connection and with adjustable height, and the support assembly (20, 20') holds and supports said pivot bearings (25) of the driving arms (21, 21').

6. The wheelchair as claimed in claim 3, wherein respective brake holders (40, 40') are attached to the rear side of said driving arms (21, 21') extending out in backward direction towards the large wheel (12 or 13) and a respective brake pad (41 or 41') is attached to each brake holder (40, 40') that in the rearmost position of the associated driving arm (21, 21') gets pressed to a rubber tyre on the large wheel (12, 13) to brake that wheel.

7. The wheelchair as claimed in claim 2, wherein respective brake holders (40, 40') are attached to the rear side of said driving arms (21, 21') extending out in backward direction towards the large wheel (12 or 13) and a respective brake pad (41 or 41') is attached to each brake holder (40, 40') that in the rearmost position of the associated driving arm (21, 21') gets pressed to a rubber tyre on the large wheel (12, 13) to brake that wheel.

* * * * *